US009415894B2

(12) United States Patent
Mast et al.

(10) Patent No.: US 9,415,894 B2
(45) Date of Patent: Aug. 16, 2016

(54) PRESSURE RESISTANT VACUUM/LABEL PANEL

(71) Applicant: AMCOR LIMITED, Hawthorn (AU)

(72) Inventors: Luke A. Mast, Brooklyn, MI (US); Bradley S. Philip, Tecumseh, MI (US)

(73) Assignee: Amcor Limited, Hawthorn (AU)

( * ) Notice: Subject to any disclaimer, the term of this patent is extended or adjusted under 35 U.S.C. 154(b) by 0 days.

(21) Appl. No.: 14/602,680

(22) Filed: Jan. 22, 2015

(65) Prior Publication Data

US 2015/0129537 A1 May 14, 2015

Related U.S. Application Data

(63) Continuation-in-part of application No. 13/171,826, filed on Jun. 29, 2011, now abandoned.

(60) Provisional application No. 61/360,084, filed on Jun. 30, 2010.

(51) Int. Cl.

| | |
|---|---|
| ***B65D 1/44*** | (2006.01) |
| ***B65D 1/02*** | (2006.01) |
| ***B65D 79/00*** | (2006.01) |

(52) U.S. Cl.

CPC ..... *B65D 1/44* (2013.01); *B65D 1/0223* (2013.01); *B65D 79/005* (2013.01)

(58) Field of Classification Search

CPC ..... B65D 1/44; B65D 1/0223; B65D 79/005
See application file for complete search history.

(56) References Cited

U.S. PATENT DOCUMENTS

| | | | | |
|---|---|---|---|---|
| D161,698 | S | 1/1951 | Lorenzen | |
| 2001/0030167 | A1* | 10/2001 | Mooney | B65D 1/0223 215/384 |
| 2006/0091102 | A1 | 5/2006 | Bourque et al. | |
| 2006/0186083 | A1* | 8/2006 | Joshi | B65D 1/0223 215/381 |
| 2007/0039918 | A1 | 2/2007 | Lane et al. | |
| 2008/0083696 | A1 | 4/2008 | Nievierowski et al. | |
| 2009/0283495 | A1 | 11/2009 | Lane et al. | |

* cited by examiner

*Primary Examiner* — Stephen Castellano
(74) *Attorney, Agent, or Firm* — Harness, Dickey & Pierce, PLC

(57) ABSTRACT

A container comprising a finish, a sidewall portion extending from the finish, a base portion extending from the sidewall portion and enclosing the sidewall portion to form a volume therein for retaining a commodity, and a plurality of horizontally disposed rib members disposed in at least one of the sidewall portion and the base portion. The plurality of horizontally disposed rib members is continuously disposed about the sidewall portion or the base portion and, in some embodiments, defines a perimeter length about 3-5% shorter than perimeter lengths of adjacent lands. The plurality of horizontally disposed rib members providing improved structural integrity such that a pre-fill size of the container is approximately equal to a post-filled, cooled size of the container.

15 Claims, 4 Drawing Sheets

PRESSURE RESISTANT VACUUM/LABEL PANEL

CROSS-REFERENCE TO RELATED APPLICATIONS

This application is a continuation-in-part of U.S. patent application Ser. No. 13/171,826, filed on Jun. 29, 2011, now abandoned, which claims the benefit of U.S. Provisional Application No. 61/360,084, filed on Jun. 30, 2010. The entire disclosures of each of the referenced applications are incorporated herein by reference.

FIELD

This disclosure generally relates to containers for retaining a commodity, such as a solid or liquid commodity. More specifically, this disclosure relates to a container having optimized horizontal ribs at an optimum perimeter length to act as a belt/strap to maintain container shape.

BACKGROUND AND SUMMARY

This section provides background information related to the present disclosure which is not necessarily prior art. This section also provides a general summary of the disclosure, and is not a comprehensive disclosure of its full scope or all of its features.

As a result of environmental and other concerns, plastic containers, more specifically polyester and even more specifically polyethylene terephthalate (PET) containers are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where $\rho$ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25%-35%.

Unfortunately, with some applications, as PET containers for hot fill applications become lighter in material weight, it becomes increasingly difficult to create functional designs that can simultaneously resist fill pressures, absorb vacuum pressures, and withstand top loading forces. According to the principles of the present teachings, the problem of expansion under the pressure caused by the hot fill process is improved by creating unique vacuum/label panel geometry that resists expansion, maintains shape, and shrinks back to approximately the original starting volume due to vacuum generated during the product cooling phase. The present teachings further improve top loading functionality through the use of arches and column corners in some embodiments.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1A:
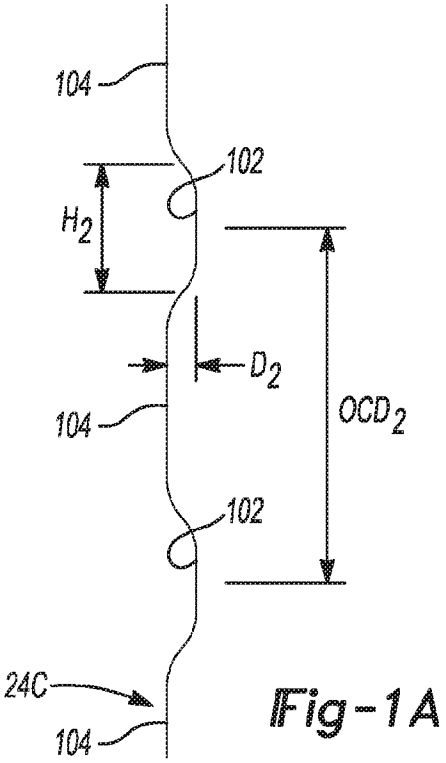
FIG. 1A is a close-up view of area 1A of FIG. 1.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

This disclosure provides for a container being made of PET and incorporating a series of horizontal rib features having an optimized size and shape that resists container expansion caused by hot fill pressure and acts as a belt/strap to help maintain container shape.

It should be appreciated that the size and specific configuration of the container may not be particularly limiting and, thus, the principles of the present teachings can be applicable to a wide variety of PET container shapes. Therefore, it should be recognized that variations can exist in the present embodiments. That is, it should be appreciated that the teachings of the present disclosure can be used in a wide variety of containers, including reusable/disposable packages including resealable plastic bags (e.g., ZipLock® bags), resealable containers (e.g., TupperWare® containers), dried food containers (e.g., dried milk), drug containers, chemical packaging, squeezable containers, recyclable containers, and the like.

Accordingly, the present teachings provide a plastic, e.g. polyethylene terephthalate (PET), container generally indicated at 10. The exemplary container 10 can be substantially elongated when viewed from a side and rectangular when viewed from above. Those of ordinary skill in the art would appreciate that the following teachings of the present disclosure are applicable to other containers, such as rectangular, triangular, pentagonal, hexagonal, octagonal, polygonal, or square shaped containers, which may have different dimensions and volume capacities. It is also contemplated that other modifications can be made depending on the specific application and environmental requirements.

In some embodiments, container 10 has been designed to retain a commodity. The commodity may be in any form such as a solid or semi-solid product. In one example, a commodity may be introduced into the container during a thermal process, typically a hot-fill process. For hot-fill bottling applications, bottlers generally fill the container 10 with a product at an elevated temperature between approximately 155° F. to 205° F. (approximately 68° C. to 96° C.) and seal the container 10 with a closure before cooling. In addition, the plastic container 10 may be suitable for other high-temperature pasteurization or retort filling processes or other thermal processes as well. In another example, the commodity may be introduced into the container under ambient temperatures.

Figure 1:
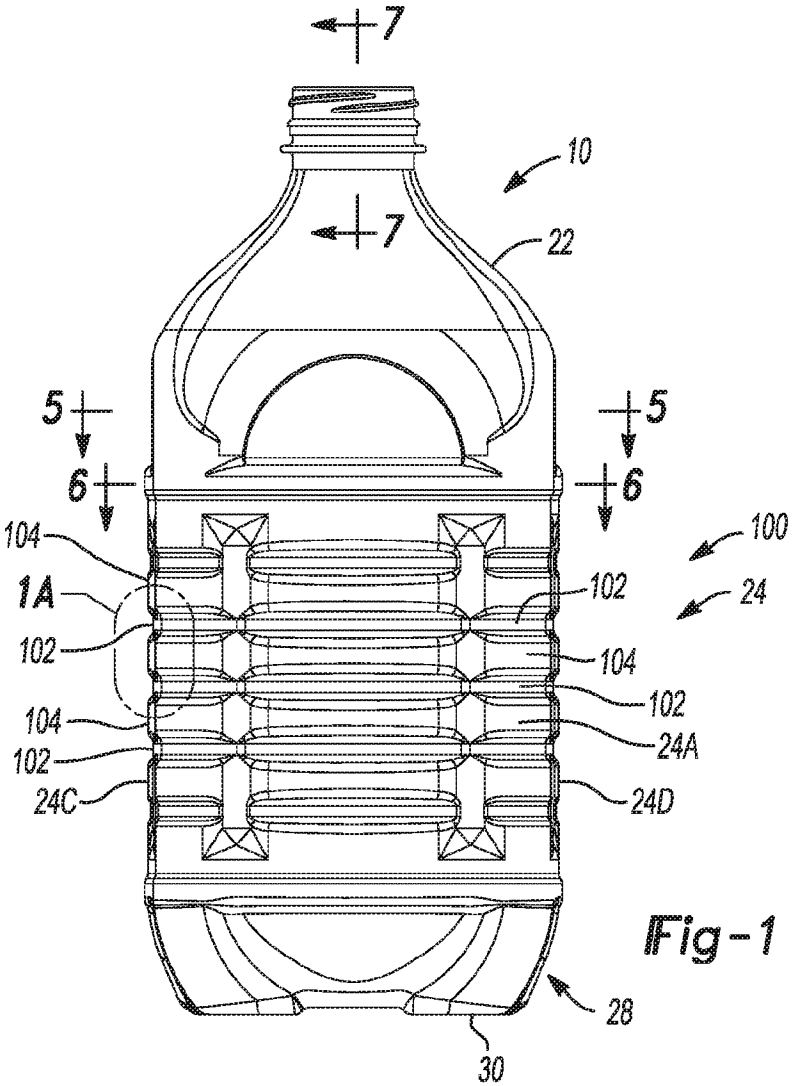
FIG. 1 is a front view of an exemplary container incorporating the features of the present teachings.

As shown in FIG. 1, the exemplary plastic container 10 according to the present teachings defines a body 12, and includes an upper portion 14 having a cylindrical sidewall 18 forming a finish 20. Integrally formed with the finish 20 and extending downward therefrom is a shoulder portion 22. The shoulder portion 22 merges into and provides a transition between the finish 20 and a sidewall portion 24. The sidewall portion 24 extends downward from the shoulder portion 22 to a base portion 28 having a base 30. In some embodiments, sidewall portion 24 can extend down and nearly abut base 30, thereby minimizing the overall area of base portion 28 such that there is not a discernable base portion 28 when exemplary container 10 is uprightly-placed on a surface.

The exemplary container 10 may also have a neck 23. The neck 23 may have an extremely short height, that is, becoming a short extension from the finish 20, or an elongated height, extending between the finish 20 and the shoulder portion 22.

The upper portion 14 can define an opening for filling and dispensing of a commodity stored therein. Although the container is shown as a beverage container, it should be appreciated that containers having different shapes, such as sidewalls and openings, can be made according to the principles of the present teachings.

The finish 20 of the exemplary plastic container 10 may include a threaded region 46 having threads 48, a lower sealing ridge 50, and a support ring 51. The threaded region provides a means for attachment of a similarly threaded closure or cap (not shown). Alternatives may include other suitable devices that engage the finish 20 of the exemplary plastic container 10, such as a press-fit or snap-fit cap for example. Accordingly, the closure or cap engages the finish 20 to preferably provide a hermetical seal of the exemplary plastic container 10. The closure or cap is preferably of a plastic or metal material conventional to the closure industry and suitable for subsequent thermal processing.

In some embodiments, the container 10 can comprise a label/vacuum panel area 100 generally disposed along sidewall portion 24. In some embodiments, panel 100 can be disposed in other areas of the container 10, including the base portion 28 and/or shoulder portion 22. Panel area 100 can comprise a series or plurality of rib members 102 generally disposed horizontally about container 10. Rib members 102 can be formed to have minimum curves and radii for improved structural integrity, and less perimeter length compared to the perimeter of adjacent surfaces, such as lands 104. Through their structure, rib members 102 are capable of resisting the force of internal pressure by acting as a "belt" that limits the "unfolding" of the cosmetic geometry of the container that makes up the exterior design.

Figure 8:
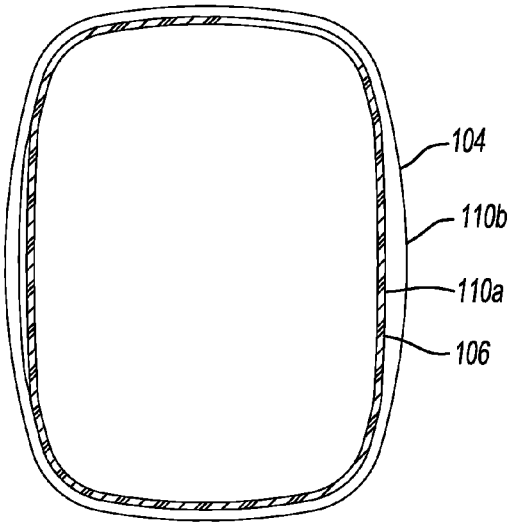
FIG. 8 is a schematic view illustrating the first perimeter length and the second perimeter length.

By way of non-limiting example and with particular reference to FIGS. 1 and 8, the rib members 102 can be formed to have a generally consistent and uniform shape throughout its circumferential track about container 10. Moreover, rib members 102 can specifically comprise a generally narrow central portion 106 extending horizontally about container 10 defining a first perimeter length 110*a* (see FIG. 8). Central portion 106 can transition to adjacent lands 104 via a continuous, inclined portion or surface 112 (see FIGS. 1-3). Surface 112 can provide a transition surface between central portion 106 and the varying shape of lands 104, which can itself include various features and contours. Adjacent lands 104 can similarly define a second perimeter length 110*b* (see FIG. 8). Second perimeter length 110*b* of adjacent lands 104 is greater than first perimeter length 110*a* of central portion 106. In some embodiments, rib members 102 can define a groove or other inwardly-directed rib feature. Rib members 102 can further extend around corners formed in the container to thereby strengthen the container.

Figure 2A:
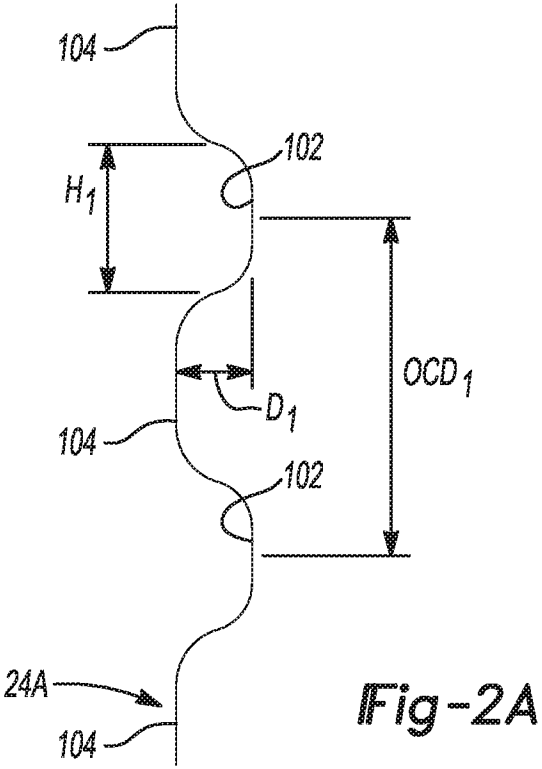
FIG. 2A is a close-up view of area 2A of FIG. 2.
Figure 2:
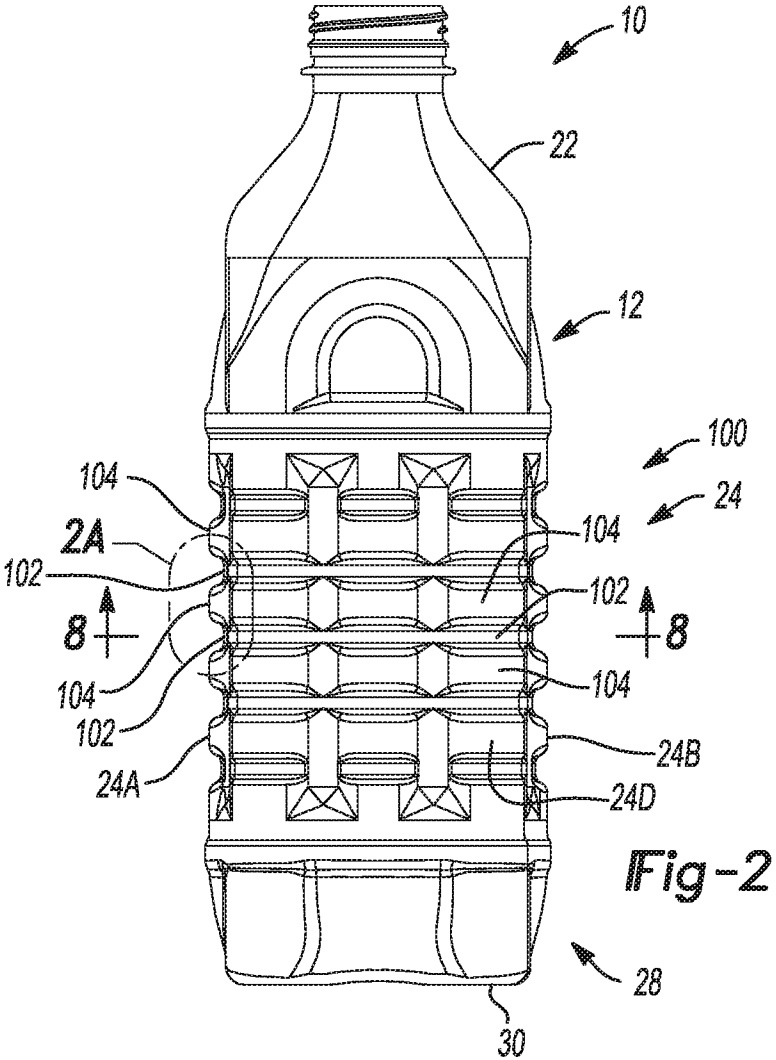
FIG. 2 is a side view of an exemplary container incorporating the features of the present teachings.
Figure 3:
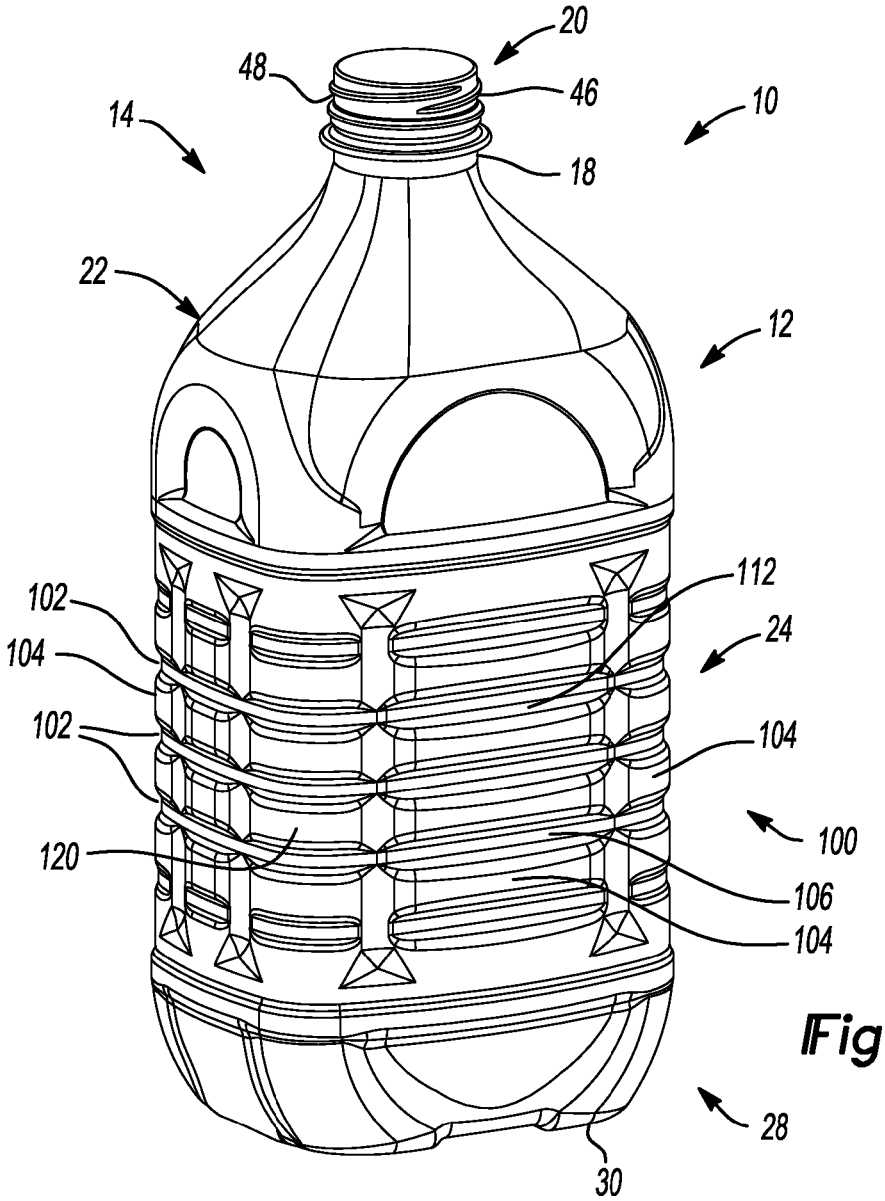
FIG. 3 is a plan view of an exemplary container incorporating the features of the present teachings.
Figure 4:
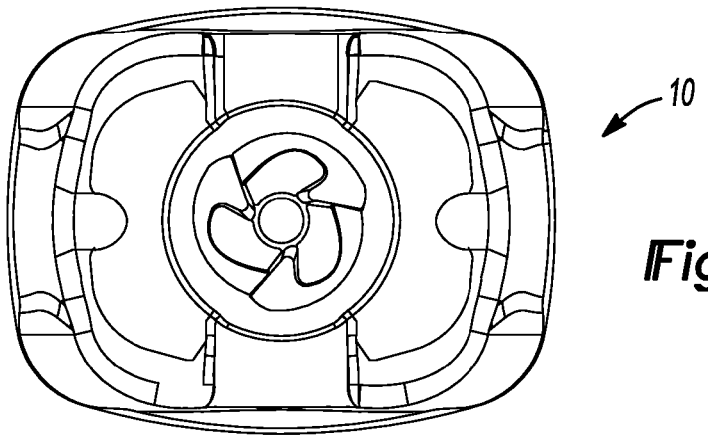
FIG. 4 is a bottom view of an exemplary container incorporating the features of the present teachings.
Figure 5:
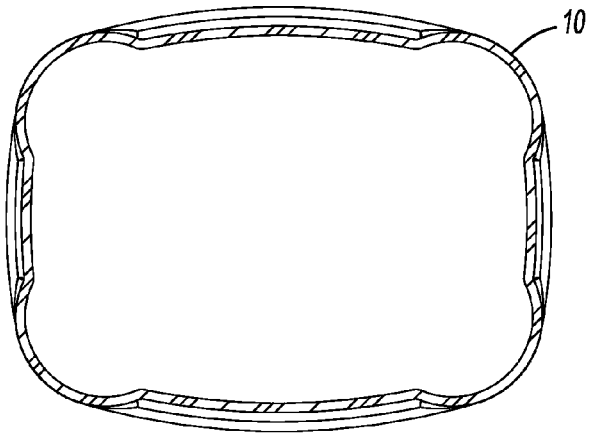
FIG. 5 is a cross-sectional view of an exemplary container incorporating the features of the present teachings taken along line 5-5 of FIG. 1.
Figure 6:
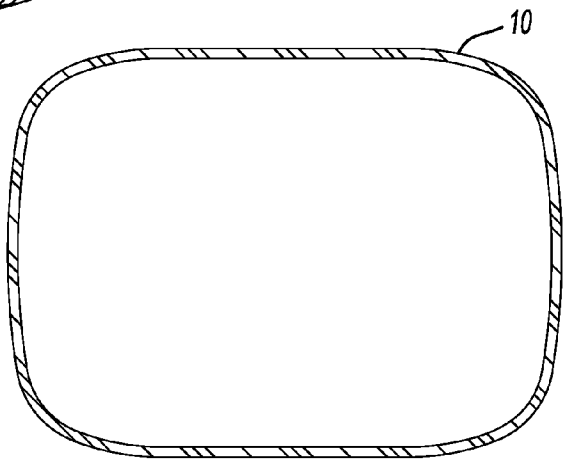
FIG. 6 is a cross-section view of an exemplary container incorporating the features of the present teachings.
Figure 7:
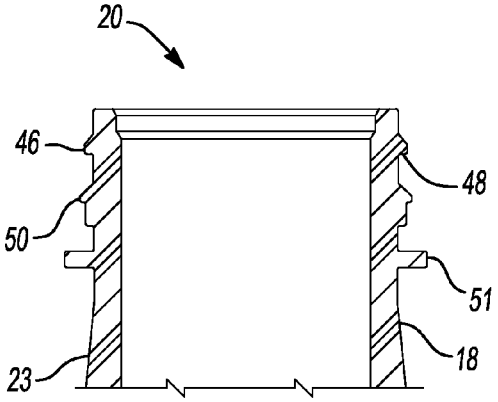
FIG. 7 is a cross-sectional view of the finish of an exemplary container incorporating the features of the present teachings.

In some embodiments, by way of non-limiting example, it has been found that the optimum perimeter length of rib members 102, specifically first perimeter length 110*a*, should be approximately 3-5% less than the adjacent perimeter geometry, specifically second perimeter length 110*b*. That is, in some embodiments, the first perimeter length 110*a* can be 348.84 mm and the second perimeter length 110*b* can be 360.96 mm. Moreover, in some embodiments, and as illustrated in FIGS. 2 and 2A for example, the depth $D_1$ of rib member 102 (i.e., the distance that rib member 102 extends into the container 10 and is recessed beneath land 104) at front wall 24A and rear wall 24B compared to adjacent lands 104 can be approximately equal to about one half of the overall vertical height $H_1$ of one of the rib members 102 at the front wall 24A and rear wall 24B. Additionally, in some embodiments, and as illustrated in FIGS. 1 and 1A for example, the depth $D_2$ of rib member 102 (i.e., the distance that rib member 102 extends into the container 10 and is recessed beneath land 104) at first sidewall 24C and second sidewall 24D compared to adjacent lands 104 can be approximately equal to about one quarter of the overall vertical height $H_2$ of one of the rib members 102 at the first sidewall 24C and the second sidewall 24D. Still further, in some embodiments, and as illustrated in FIGS. 2 and 2A for example, the overall vertical height $H_1$ of one of the rib members 102 at the front wall 24A and the rear wall 24B can be approximately equal to about one half of the on-center distance $OCD_1$ between adjacent rib members 102 at the front wall 24A and the rear wall 24B. As illustrated in FIGS. 1 and 1A for example, the overall vertical height $H_2$ of one of the rib members 102 at the first sidewall 24C and the second sidewall 24D can be approximately equal to about one half of the on-center distance $OCD_2$ between adjacent rib members 102 at the first sidewall 24C and the second sidewall 24D. Still further, in some embodiments, the overall vertical height of panel area 100 can generally equal about 50% (e.g. 40-60%) of the overall height of the container 10 when viewed from either the front wall 24A or the rear wall 24B.

Distribution of rib members 102 has further been found to improve the structural integrity of container 10. Specifically, in some embodiments, it has been found that rib members 102 can be disposed parallel and equally spaced along sidewall portion 24 and/or panel area 100. That is, in some embodiments, performance was optimized by using five (5) rib members 102 equally spaced within a 4.2" high label panel (i.e. panel area 100), or about one rib every 0.7" vertically. Rib members 102 can be generally located at a central portion of sidewall portion 24, where expansion and contraction forces are most extreme.

In some embodiments, it has also been found that improved performance is realized by continuing rib member 102 within and through any corner features 120 formed in container 10. In this way, the belt function of rib member 102 is improved and maximized, thereby adding stiffness and resisting roll out under pressure.

By using the principles of the present teachings, the expansion under fill pressure of 2.3 psi was reduced from 111 cc to 83 cc compared to current panel design. This is an improvement of about 25% over typical or conventional panel design.

It should be appreciated that the principles of the present teachings further provide a container that is particularly well-suited to resist ovalization and thus maintain a rectangular shape (or other desired shape) during filling compared to similar designs not using the rib members of the present teachings. During filling, the container of the present teachings is often under a vacuum due to cooling and thus exhibits a shrinking response. The present container, however, is unique in that it expands during initial filling an amount that is generally equal to the amount of shrinkage that occurs during cooling, thereby resulting in a final, post-filled and cooled shape that closely conforms to an initial, pre-filled shape. It should thus be understood that the container of the present teachings is capable of maintaining an intended shape pre-versus post-filling.

One skilled in the art will recognize that containers such as that in the present application can often be exposed to vacuum forces created during cooling of the commodity. It is thus important for the container to adequately manage such forces. In the case of the container of the present teachings, it has been found that the residual vacuum within the container following cooling is generally less than about 15 mm Hg.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A container comprising:

a finish;

a sidewall portion extending from said finish, the side wall portion including a front wall, a rear wall opposite to the front wall, a first sidewall, and a second sidewall opposite to the first sidewall;

a base portion extending from said sidewall portion and enclosing said sidewall portion to form a volume therein for retaining a commodity; and a plurality of horizontally disposed rib members disposed in said sidewall portion, said plurality of horizontally disposed rib members being continuously disposed about said sidewall portion, one of said plurality of horizontally disposed rib members of the front wall or the rear wall having a depth generally equal to about one half of an overall vertical height thereof, and one of said plurality of horizontally disposed rib members of the first or second sidewalls having a depth generally equal to about one quarter of an overall vertical height thereof, said overall vertical height of one of said plurality of horizontally disposed rib members of the front wall or the rear wall is generally equal to about one half of an on-center distance between adjacent ones of said plurality of horizontally disposed rib members of the front wall or the rear wall, and said overall vertical height of one of said plurality of horizontally disposed rib members of the first sidewall or the second sidewall is generally equal to about one half of an on-center distance between adjacent ones of said plurality of horizontally disposed rib members of the first sidewall or the second sidewall;

wherein said plurality of horizontally disposed rib members resist deformation of the container such that a size of expansion of the container during filling is approximately equal to a size of contraction of the container during cooling; and wherein at least one of said plurality of horizontally disposed rib members comprises a continuous groove about said sidewall portion.

2. The container according to claim 1 wherein at least one of said plurality of horizontally disposed rib members defines a perimeter length that is about 3-5% smaller than a perimeter length of lands adjacent to said at least one rib member.

3. The container according to claim 1 wherein said plurality of horizontally disposed rib members are spaced about 0.7 inches from each other.

4. The container according to claim 1 wherein said plurality of horizontally disposed rib members resist ovalization of said sidewall portion.

5. The container according to claim 1 wherein a residual vacuum within the container following filling and cooling is generally equal to about 15 mm Hg.

6. The container according to claim 1, further comprising:

lands disposed between adjacent ones of said plurality of horizontally disposed rib members, wherein said at least one of said plurality of horizontally disposed rib members defines a first perimeter length and said lands define a second perimeter length, said first perimeter length being smaller than said second perimeter length.

7. The container according to claim 6 wherein said first perimeter length is about 348 mm and said second perimeter length is about 361 mm.

8. The container according to claim 1 wherein at least one of said plurality of horizontally disposed rib members extends about each corner of said sidewall portion, thereby providing increased structural integrity.

9. The container according to claim 1 wherein said plurality of horizontally disposed rib members are positioned on a panel area of the sidewall portion and an overall height of said panel area is equal to about 40% to about 60% of the total height of the container.

10. A container comprising:

a finish;

a sidewall portion extending from said finish, the sidewall portion including a front wall, a rear wall opposite to the front wall, a first sidewall, and a second sidewall opposite to the first sidewall;

said sidewall portion having a plurality of horizontally disposed rib members disposed therein being separated by adjacent lands, said plurality of horizontally disposed rib members being continuously disposed about said sidewall portion to form at least one continuous groove extending about said sidewall portion, one of said plurality of horizontally disposed rib members of the front wall or the rear wall having a depth generally equal to about one half of an overall vertical height thereof, and one of said plurality of horizontally disposed rib members of the first or second sidewalls having a depth generally equal to about one quarter of an overall vertical height thereof, said overall vertical height of one of said plurality of horizontally disposed rib members of the front wall or the rear wall is generally equal to about one half of an on-center distance between adjacent ones of said plurality of horizontally disposed rib members of the front wall or the rear wall, and said overall vertical height of one of said plurality of horizontally disposed rib members of the first sidewall or the second sidewall is generally equal to about one half of an on-center distance between adjacent ones of said plurality of horizontally disposed rib members of the first sidewall or the second sidewall; and a base portion extending from said sidewall portion and enclosing said sidewall portion to form a volume therein for retaining a commodity;

wherein said plurality of horizontally disposed rib members resist deformation of the container such that a size of expansion of the container during filling is approximately equal to a size of contraction of the container during cooling; and wherein said plurality of horizontally disposed rib members are positioned on a panel area of the sidewall portion and an overall height of said panel area is equal to about 40% to about 60% of the total height of the container.

11. The container according to claim 10 wherein at least one of said plurality of horizontally disposed rib members defines a perimeter length that is about 3-5% smaller than a perimeter length of said lands.

12. The container according to claim 10 wherein said plurality of horizontally disposed rib members are spaced about 0.7 inches from each other.

13. The container according to claim 10 wherein said plurality of horizontally disposed rib members resist ovalization of said sidewall portion.

14. The container according to claim 10 wherein a residual vacuum within the container following filling and cooling is generally equal to about 15 mm Hg.

15. The container according to claim 10 wherein at least one of said plurality of horizontally disposed rib members extends about each corner of said sidewall portion, thereby providing increased structural integrity.

* * * * *